US010950973B2

(12) United States Patent
Hale

(10) Patent No.: US 10,950,973 B2
(45) Date of Patent: Mar. 16, 2021

(54) WATERTIGHT PLUG ASSEMBLY

(71) Applicant: Wintergreen Corporation, Alpharetta, GA (US)

(72) Inventor: William Hale, Alpharetta, GA (US)

(73) Assignee: Wintergreen Corporation, Alpharetta, GA (US)

( * ) Notice: Subject to any disclaimer, the term of this patent is extended or adjusted under 35 U.S.C. 154(b) by 0 days.

(21) Appl. No.: 16/656,364

(22) Filed: Oct. 17, 2019

(65) Prior Publication Data

US 2020/0127412 A1 Apr. 23, 2020

Related U.S. Application Data

(60) Provisional application No. 62/747,093, filed on Oct. 17, 2018.

(51) Int. Cl.
*H01R 13/52* (2006.01)

(52) U.S. Cl.
CPC ..... *H01R 13/5219* (2013.01); *H01R 13/5202* (2013.01)

(58) Field of Classification Search
CPC ..... H01R 13/5219
See application file for complete search history.

(56) References Cited

U.S. PATENT DOCUMENTS

| | | | | |
|---|---|---|---|---|
| 2,647,245 | A | 7/1953 | Gilbert | |
| 3,945,701 | A * | 3/1976 | Boeke | H01R 13/523 439/281 |
| 4,940,424 | A | 7/1990 | Odbert | |
| 4,998,891 | A * | 3/1991 | Bresko | H01R 13/639 439/367 |
| 5,087,209 | A | 2/1992 | Faucher | |
| 6,350,139 | B1 | 2/2002 | Haag | |
| 8,870,587 | B2 | 10/2014 | Nooner | |
| 9,413,101 | B1 | 8/2016 | Nooner | |

* cited by examiner

*Primary Examiner* — Ross N Gushi
(74) *Attorney, Agent, or Firm* — Rachel H. Huffstetler; FisherBroyles, LLP

(57) ABSTRACT

A watertight plug assembly for electrical cords. One cord is connected to one plug end having a plug end proximal face and a sidewall. The sidewall includes a first mating member adjacent the proximal face. The second plug end is connected to a second cord and includes a cap having a central cavity for receiving the second plug end and which defines a second mating member to cooperate with the first mating member when said plug ends are connected to provide a watertight connection.

21 Claims, 4 Drawing Sheets

WATERTIGHT PLUG ASSEMBLY

CROSS REFERENCE TO RELATED APPLICATIONS

This application claims priority to and the benefit of U.S. Ser. No. 62/747,093 filed Oct. 17, 2018, the disclosure of which is incorporated in its entirety.

FIELD OF THE INVENTION

The present invention is directed to a water tight plug and, more specifically, to a plug end which may be used for decorative lighting, such as string lights, an accessory for custom electrical cords or an extension cord, for decorative or other lighting purposes.

BACKGROUND OF THE INVENTION

Decorative lights for illuminating indoor and outdoor structures, such as trees for celebrations or holidays, is commonplace. Particularly with respect to outdoor use, lighting accessories must sustain environmental conditions such as rain or snow. As such, it is beneficial to provide a plug end which is watertight and, therefore weatherproof in outdoor environments. Moreover, it is beneficial to provide lighting products which may be used indoors and outdoors.

SUMMARY OF THE INVENTION

It is, therefore, advantageous for a plug end to be watertight. This is particularly useful for use with plug ends including a fuse. These and other objectives are met by the present invention.

The present invention overcomes shortcomings of the prior art by providing a novel plug end including a water tight cap which selectively covers one end, such as the male end, of a plug to threadingly mate with the opposing, such as the female end, of a light plug.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

Figure 1B:
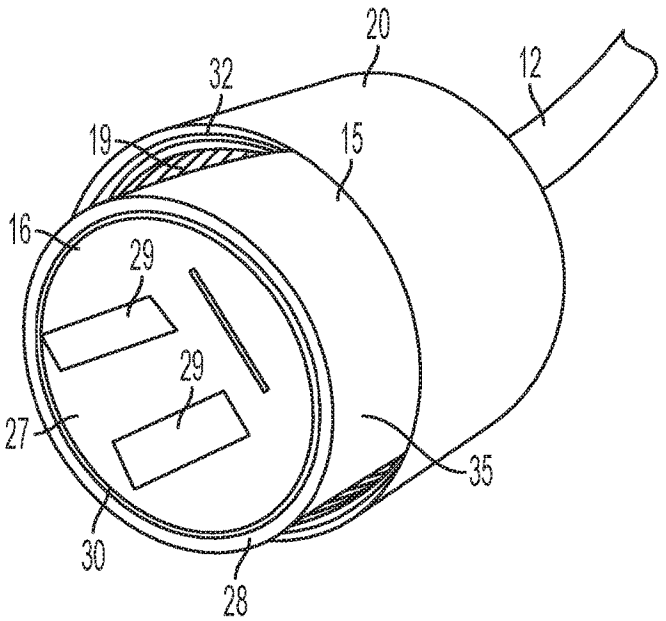
FIG. 1B is a perspective view of a male plug end of the watertight plug assembly used with the plug end of FIG. 1A with a threadable cap thereon.

The plug end 10 is shown in various applications in the Figures which are provided as exemplary uses of the plug end 10. FIGS. 1A-1B illustrate the plug end 10 used with a cord 12, such as coaxial cable 12 (for example, decorative string lights). The female plug 14 and male plug 15 each define a proximal end 16 and distal end 17. The cord 12 shown in FIGS. 1A and 1B extends from the distal end 17 of each.

A cap 20 is positioned on the cord 12 wherein the cord 12 extends through a distal surface of the cap which defines an aperture for receipt of the cord 12. The male plug 15 is configured so as to be received within a cavity 19 of the cap 20 and the cap 20 is configured to removably receive the male plug 15.

The proximal face 22 of the female plug 14 defines a ledge 24 or flange extending circumferentially around the proximal face 22. The ledge 24, thus, is recessed a predetermined amount relative to the proximal face. Alternatively, a flange 24 would protrude outward relative to the proximal face. For the sake of discussion herein, a ledge is shown and described. The amount shown is by way of example and a deeper recession may be selected. The proximal face 22 also includes a power connecting such as female receptacles 25. An outer surface of the female receptacle 14 includes circumferentially extending external threads 26 adjacent its proximal end 16. A seal, such as an elastomeric O-ring, may also be placed around the proximal face 22 if there is a flange.

The proximal face 27 of the male plug 15 is configured to mate with the proximal face 22 of the female plug 14. The proximal face 27 defines an outer flange (relative to the proximal face 22) configured for receipt of a sealing member 30, such as an elastomeric O-ring and configured to be received by the ledge 24 of the female plug end 14. The proximal face 27 alternatively defines an outer recess defining a seat configured to receive the flange 24 of the female plug end 14. The O-ring 30 and the proximal face 27 are configured to be received by the proximal face 22 of the female plug 14 wherein the ledge 24 engages the O-ring 30. According to another aspect of the invention, proximal faces of both the male and female plug ends 14, 16 may be flush with no ledge, flange or O-ring. The proximal face 27 also supports a power connecting interface, such as male prongs 29, which are configured for receipt within the female receptacle 25.

The cap 20 internal cavity 19 defines an interior facing threaded portion 32 which is configured to mate with the threaded portion 26 of the female plug 14. When the male plug 15 is connected to the female plug 14, the connection is secured by the proximal end faces 22 and 27 described above. The plug 10 becomes substantially water tight by the further application of the cap 20. The cap 20 is moved distally along the male plug 14 so as to engage the threaded outer portion 26 of the female plug 14. The cap 20 is then rotated and the interior threads 32 of the cap engage the threaded portion 26 of the female plug 14 until the cap is fully threaded thereon. Removal of the cap 30 is effectuated by rotation in the opposite direction. The male plug 14 includes a sliding fuse panel for receipt of a fuse (not shown).

Figure 1C:
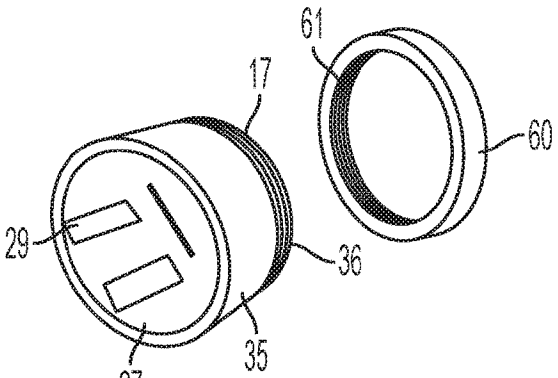
FIG. 1C is a perspective view of a stackable plug according to another aspect of the invention.
Figure 1A:
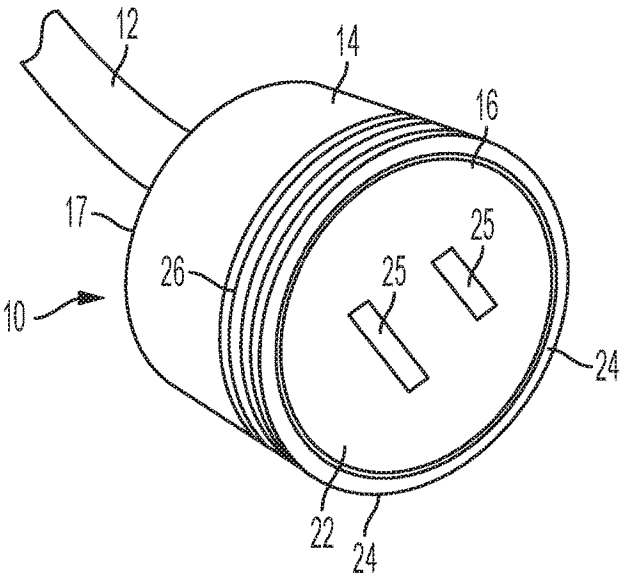
FIG. 1A is a perspective view of a female plug end of the watertight plug assembly according to one aspect of the invention.
Figure 1D:
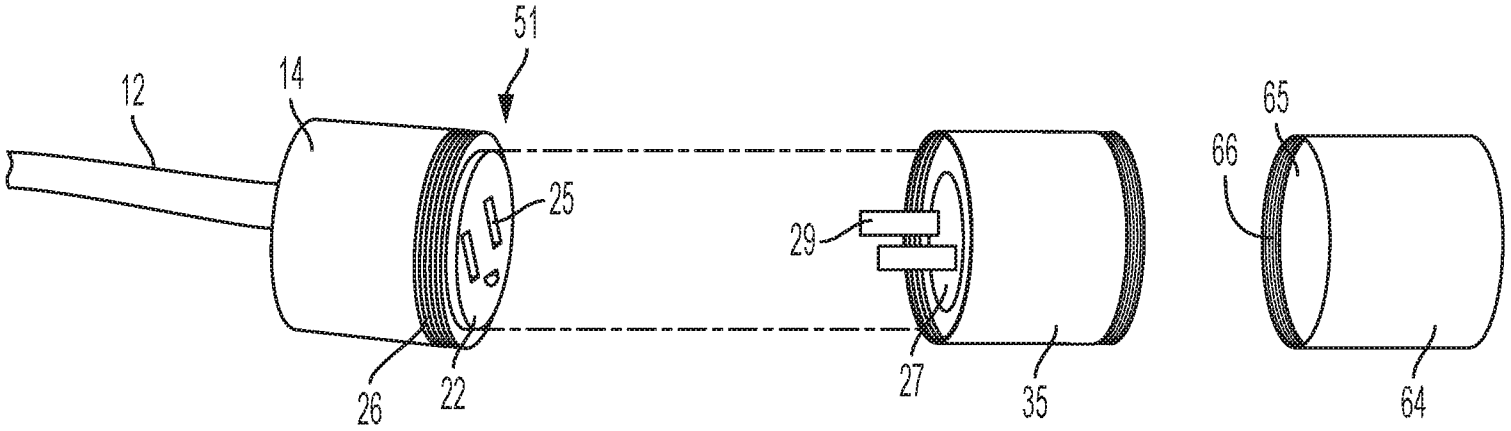
FIG. 1D is an exploded view of the watertight plug assembly including the stackable plug of FIG. 1C.

FIG. 1C illustrates a stackable plug 35 having third power connecting interface 29 on its proximal face. The distal end 17 of the stackable plug 35 includes a fourth power connecting interface, such as female plug 14, similar to the female plug interface shown in FIG. 1A (not also shown in FIG. 1C). A distal portion of the male plug 35 includes a threaded portion 36 configured to mate with a cap 20 as described herein of another end plug 10. A second cap 60 as shown in FIG. 1C is selectively provided for the stackable plug 35 when the stackable plug 35 is the end of a run of power connectors; meaning that the female plug 14 is not in use. Referring to FIG. 1D, the female plug end 14 of the stackable plug 35, when in use, is covered by a second cap 20 previously described (not shown in FIG. 1D) wherein the cap thread portion 32 matingly engages the threaded portion 36 of the stackable plug 35. As shown in FIG. 1D the stackable plug 35 selectively includes a modified second cap 64 according to another aspect of the present invention which defines a central channel 65 and threaded, inwardly facing portion 66 adjacent one end thereof for cooperating with the threaded portion 26 of the female receptable 14. The female distal plug end shown in FIG. 1D may engage with a second cap 60 as shown in FIG. 1C, a second cap 20 as shown in FIG. 1B, or another stackable plug 35.

Figure 2A:
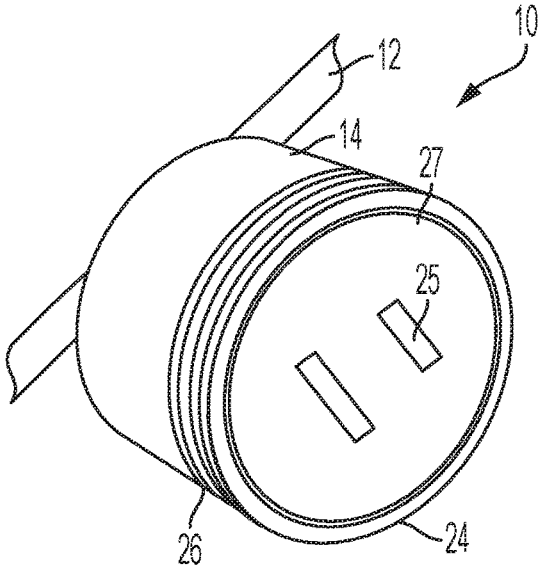
FIG. 2A is a perspective view of a female plug end of the watertight plug assembly according to another aspect of the invention.
Figure 2B:
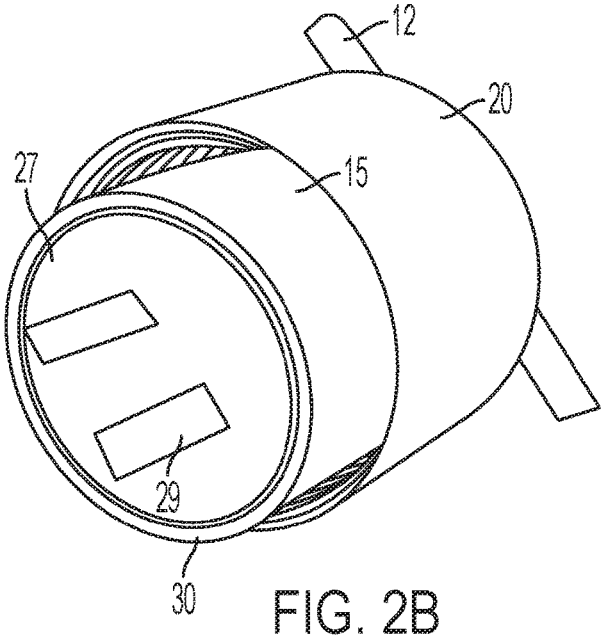
FIG. 2B is a perspective view of a male plug end of the watertight plug assembly used in connection with the plug of FIG. 2A.
Figure 2C:
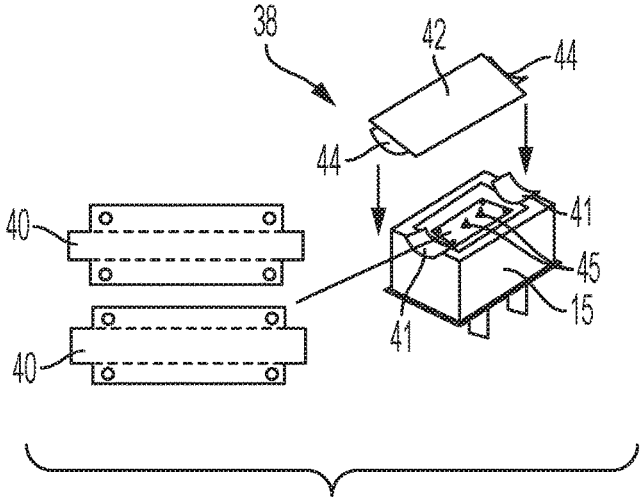
FIG. 2C is representative view of the cord connection according to one aspect of the invention.

FIGS. 2A-2C depict an end plug 10 connected to cord 12 according to another aspect of the invention. According to these Figures, the end plug 10 may selectively be applied to the cord 12, such as at custom positions along the length of the cord 12. These are referred to as zip plugs or slide on plugs. The cord 12, at least initially, is not integrated with the end plug 10. The cord 12 extends substantially parallel to the distal end 17 of the female 14 and male 15 plugs shown. The distal ends 17 of each male 15 and female 14 plugs include a cord interface 38 which defines at least one, or as shown, two channels 40 defined by a plate which may have different dimensions to receive differently sized cords 12. The cord interface 38 may include more than one plate with different sized channels 40 or a two sided plate having different sized channels 40 on each side. A pair of gaskets 41 are positioned adjacent opposing ends of the channels 40 as shown in FIG. 2C.

In use, the cord 12 is positioned within a channel 40 and a plug cover 42 having mating members 44, shown as curved T-flaps, is pressed against the cord 12 and interface 38. The cord interface 38 includes at least one, or as shown, two metal contacts 45. Pressure applied to the plug cover 42 such as by applying it to the cord interface 38, urges the cord 12 against the metal contacts 45 which pierce the cord 12 coating to so as to contact the wire therein to complete the electrical circuit. This is facilitated by the compression of the T-flaps 44 and the gasket 41 which seal the cord interface 38. As shown in FIG. 2C, the cord interface 38 is illustrated as rectangular and is representative of a distal portion of the end plug 14 or 15. The cord interface 38 is integrated with the male 15 of female 14 plug distal surface 17.

Figure 3C:
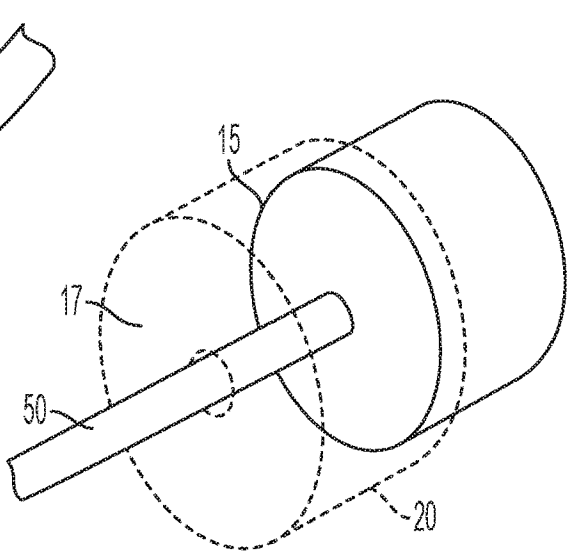
FIG. 3C is a rear view of the male plug of FIG. 3B.
Figure 3B:
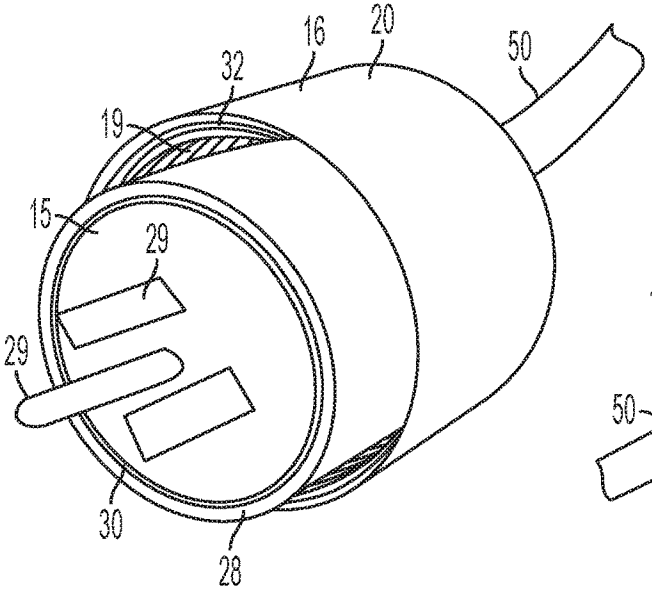
FIG. 3B is a perspective view of a male plug end used in connection with the plug of FIG. 3A.
Figure 3A:
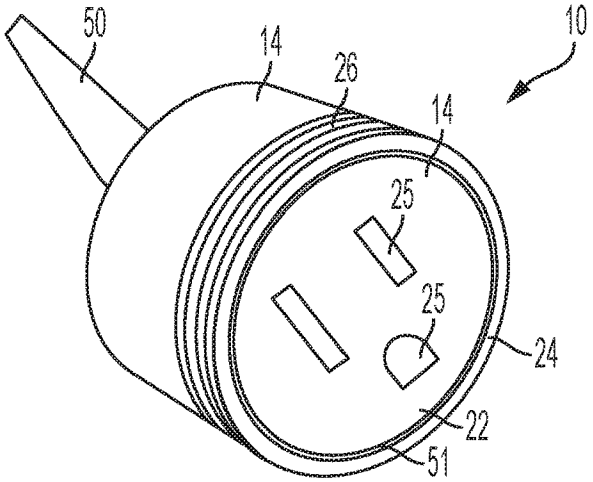
FIG. 3A is a perspective view of a female plug end of the watertight plug assembly for use with an extension cord according to another aspect of the invention.

FIGS. 3A-3C illustrate the plug end according to another aspect wherein the plug end 38 is coupled to a larger, more powerful, power cord such as used as an extension cord 50. The female plug 14 proximal face 22 additionally includes a proximal face threaded portion 51 which extends circumferentially around the proximal face 22, interior to the ledge 24. The proximal face threaded portion 51 may be provided either as a groove having internal threaded portion 51 or a flange having an outwardly facing threaded portion 51, such as a sidewall of the flange, to mate with the cap threaded portion 32 of a smaller male plug 16, such as the one shown in FIG. 1B. The female plug 14 of FIG. 3A is also configured to cooperate with the larger male plug 16 associated with an extension cord in the manner previously described wherein the cap 20 engages the threaded portion 26 of the female connector 14. Thus, the female end plug shown in FIG. 3A may matingly engage various sizes of male end plugs 16, while at least partially sealing therewith. In this regard, the female plug 14 is compatible for varying sizes of male plugs 15. The cap 20, although larger in scale than the aforementioned Figures, is then proximally moved to engage the female plug 14 and secured thereto by rotational forces, thereby providing a substantially watertight connection. FIG. 3C illustrates the connection of the cord 50 (and representative also of cord 12 described above) with the distal end of the male plug 15 with the cap 20 shown in phantom and "floating" on the cord 50.

As shown and described, particular features are provided on the female plug 14 and the male plug 15. As is obvious to one of ordinary skill in the art, features of one plug may be provided on the other plug without departing from the scope of this invention. For example, the cap 20 may be provided on the female plug 14 and interface with a male plug 14 threaded proximal surface (not shown). As shown, the caps 20, 64 and 60 and plug ends 14 and 16 are shown to have a circular cross-section, this is by way of example and these members may be of any geometric shape, such as generally oval or other regular or irregular shape.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A watertight plug assembly for providing a substantially watertight electrical connection between a first and second power cord comprising:

a first plug end electronically coupled to the first power cord on a distal end of said first plug end wherein said first plug end includes a proximal face and sidewalls extending substantially perpendicular to said proximal face wherein said proximal face defines a first power connecting interface, and wherein said first plug end sidewall comprises a first mating member positioned adjacent said proximal face;

a second plug end coupled to the second power cord on a distal end of said second plug end wherein said second plug end includes a proximal face which defines a second power connecting interface configured to matingly engage said first power connecting interface to transfer power from said first plug end to said second plug end; and a cap defining a central cavity configured for receipt of said second plug end and a distal aperture configured for receipt of said second power cord wherein said cap is slidable between a first disengaged position to a second watertight position, said cap defining a second mating member defined by an inner facing surface of said cap central cavity and configured to matingly engage said first mating member of said first plug end to secure said first and second plug ends to provide a watertight connection in said watertight position;

wherein said first plug end proximal face defines at least one ledge extending substantially around an outer perimeter of said first plug end proximal face, said at least one ledge extending distally from said first plug end proximal face wherein said at least one ledge is recessed relative to said first plug end proximal face; and wherein said second plug end proximal face defines a flange substantially around the outer perimeter of said second plug end proximal face, said recess extending outwardly from said second plug end proximal face wherein said second plug end proximal face is recessed relative to said second plug end flange and said flange is configured to mate with and be received by said at least one first plug end recess.

2. The watertight plug assembly according to claim 1 wherein said first plug end mating member is a threaded portion defined by said first plug end sidewall which extends substantially around a perimeter of said first plug end sidewall and said cap second mating member is a threaded portion which extends substantially around a perimeter of said cap inner facing surface adjacent a proximal end of said cap.

3. The watertight plug assembly according to claim 2 further comprising a stackable plug including a sidewall extending substantially perpendicular to a distal end surface having a third power connecting interface configured to matingly engage said first power interface and said stackable plug includes a proximal end surface having a fourth power connecting interface configured to mate with said second power interface, said stackable plug sidewall defining a third mating member extending on an outwardly facing surface of said sidewall and adjacent to said stackable plug proximal end surface and configured to mate with said second mating member of said cap to provide a substantially watertight connection therebetween.

4. The watertight plug assembly according to claim 3 further comprising a second cap configured to mate with said stackable plug.

5. The watertight plug assembly according to claim 4 wherein said second cap an open distal and proximal end a threaded portion adjacent said open distal end configured to matingly engage said first mating member of said first plug end.

6. The watertight plug assembly according to claim 1 further comprising a sealing member position on said second plug recess and configured to be received by said at least one first plug end flange when said first and second plug ends are engaged.

7. The watertight plug assembly according to claim 6 wherein said sealing member is an elastomeric ring.

8. The watertight plug assembly according to claim 1 wherein at least one of said first and second cords extends generally perpendicularly to a distal end surface of a respective one of said first and second end plugs.

9. The watertight plug assembly according to claim 1 wherein at least one of said first and second cords extends generally parallel to a distal end surface of a respective one of said first and second end plugs.

10. The watertight plug assembly according to claim 9 wherein said at least one of said first and second cords extends through a zip plug cord interface and said cord interface includes a plate to accommodate varying sized cords.

11. The watertight plug assembly according to claim 10 wherein said plate defines a channel on a plate top and bottom surface wherein each channel has different widths to accommodate varying sized cords.

12. The watertight plug assembly according to claim 1 wherein said first power interface is a female receiving socket comprising at least two apertures and said second power interface is a male connector comprising at least two prongs.

13. The watertight plug assembly according to claim 12 wherein said female receiving socket comprising at least three apertures and said male connector comprising at least three prongs.

14. The watertight plug assembly according to claim 1 wherein said at least one flange of said first proximal face is threaded on an inwardly facing surface thereof and said recess of said second proximal surface includes an outwardly facing threaded sidewall extending generally perpendicular to the second proximal surface wherein said threaded sidewall matingly engages said threaded flange.

15. The watertight plug assembly according to claim 1 wherein said first plug end proximal face further comprises a proximal face threaded portion positioned generally interior to said at least one flange.

16. The watertight plug assembly according to claim 15 wherein said proximal face threaded portion is a groove recessed from said proximal face.

17. The watertight plug assembly according to claim 15 wherein said proximal face threaded portion is a second flange extending outwardly from said proximal face.

18. The watertight plug assembly according to claim 1 wherein said cap is disengaged from said first plug end in said first disengaged position.

19. The watertight plug assembly according to claim 1 wherein said cap central cavity is defined by cylindrical side walls and a distal end wall defining said distal aperture.

20. The watertight plug assembly according to claim 19 wherein said cap distal end wall is round.

21. The watertight plug assembly according to claim 1 wherein said cap is supported on said second power cord and said cap is distally disposed from said first mating member of said first plug end in said first disengaged position.

* * * * *